US008851342B2

(12) United States Patent
Carbone

(10) Patent No.: US 8,851,342 B2
(45) Date of Patent: Oct. 7, 2014

(54) SUPPLEMENTAL SUPPORT FOR INFANT CARRIER HANDLE

(76) Inventor: Nicholas D Carbone, Parker, CO (US)

( * ) Notice: Subject to any disclaimer, the term of this patent is extended or adjusted under 35 U.S.C. 154(b) by 258 days.

(21) Appl. No.: 13/314,060

(22) Filed: Dec. 7, 2011

(65) Prior Publication Data

US 2012/0175920 A1 Jul. 12, 2012

Related U.S. Application Data

(60) Provisional application No. 61/430,938, filed on Jan. 7, 2011.

(51) Int. Cl.
*A47D 13/02* (2006.01)

(52) U.S. Cl.
CPC ..... *A47D 13/02* (2013.01); *Y10S 224/907* (2013.01)
USPC ..... 224/159; 224/158; 224/271; 224/267; 224/907

(58) Field of Classification Search
USPC ..... 224/158–159, 270–272, 267, 678, 907; 108/43; D3/213; D29/120.1
See application file for complete search history.

(56) References Cited

U.S. PATENT DOCUMENTS

| | | | | | |
|---|---|---|---|---|---|
| 3,942,194 | A | * | 3/1976 | Winter | 623/65 |
| D364,008 | S | * | 11/1995 | Florio | D29/120.1 |
| 5,601,356 | A | * | 2/1997 | McWilliams | 362/103 |
| 5,658,044 | A | | 8/1997 | Krevh | |
| 5,809,614 | A | * | 9/1998 | Kretser, Jr. | 16/422 |
| 8,033,599 | B2 | * | 10/2011 | Meeker et al. | 297/183.3 |

FOREIGN PATENT DOCUMENTS

| | | | | | |
|---|---|---|---|---|---|
| JP | 2000062808 | A | * | 2/2000 | B65D 33/10 |

* cited by examiner

*Primary Examiner* — Justin Larson
*Assistant Examiner* — Scott McNurlen
(74) *Attorney, Agent, or Firm* — Kyle W. Rost

(57) ABSTRACT

An arm rest for the handle of an infant carrier is suited to support the infant carrier from a user's forearm upon a primary support with a secondary support at the rear of the primary support and disposed transversely to the primary support for interacting with the user's upper arm. A receptor attached to the top of the primary support receives the handle of an infant carrier and clamps to it. The receptor swivels with respect to the primary support to allow the user to enjoy natural arm movement while carrying the infant carrier.

22 Claims, 4 Drawing Sheets

SUPPLEMENTAL SUPPORT FOR INFANT CARRIER HANDLE

CROSS-REFERENCE TO RELATED APPLICATION

This application claims the benefit of U.S. Provisional Patent Application Ser. No. 61/430,938 filed Jan. 7, 2011.

BACKGROUND OF THE INVENTION

1. Field of the Invention

The invention generally relates to chairs and seats with a handle. More specifically, the invention relates to a handle for nonoccupant use. The invention is a supplemental support that cooperates with the handle of an infant carrier, which in addition to being a basic infant carrier, may be a combined infant carrier and infant car seat. The supplemental support provides a reception and contact area for the arm of an individual carrying the infant carrier. The supplemental support offers selective application to the handle for different users and improved ergonomics.

2. Description of Related Art Including Information Disclosed Under 37 CFR 1.97 and 1.98

Infant carriers are portable seats or beds for infants and often are designed to safely contain and transport infants weighing from four to thirty pounds. The typical infant carrier is formed of a plastic shell that is configured as the base for a seating and sleeping surface. Side walls and various types of straps are present to retain the infant against rolling out of the carrier. A pad provides a comfortable intermediate layer between the infant and the plastic shell. In order to provide for portability, the manufacturer supplies a bail style handle. The user may either hold the handle at arm's length or carry this handle over one arm, with the handle resting across the user's forearm.

Many infant carriers can be used as both a car seat and a carrier for the infant, without requiring time consuming transfer between two such devices when the infant is entering or exiting a car. Those infant carriers that are convertible into a car seat are expected to comply with applicable laws and regulations. The infant carrier might include a retaining strap that both secures the infant within the carrier for non-car-seat usage and is suited for use as an approved automotive safety belt, thus legally enabling the carrier to be used as a car seat for the infant. When used as car seats, known infant carriers are designed to snap into a stand that is secured to the car seat by a normal seat belt in the car. To be configured for use as a car seat, the handle of the infant carrier is folded back, out of the way in case of an accident. In preparation for leaving the car, the handle is raised to the carry position.

Although infant carriers primarily are constructed of light weight materials such as plastics, when the infant is present in the infant carrier, it can be too heavy for the user to comfortably carry with the bail-style handle resting across one arm. Contributing variables include the size and weight of the individual infant and the arm and body strength of the parent or other user attempting to lift the carrier.

Designers appear to be aware that infant carriers can be uncomfortable to carry. Some manufacturers pad the handle by a wrap-around sleeve. The handle often is adjustable in its swing between head to toe ends of the carrier shell. A recent U.S. patent application pub. no. 2008/0258516 suggests the placement of soft corner pads on the handle at the top corners of a squared-off bail handle. Using such a corner pad places the user's forearm in the nearside top corner. In its U.S. Pat. No. 5,658,044, a large manufacturer, Century Products, shows a squared-off bail handle with a W-shaped. top bar that is centrally cushioned. When the user carries the carrier, the W-shape automatically locates the user's forearm in the near-side top corner of the handle.

Curiously, both of the aforementioned disclosures in the Patent Office show and evidently encourage the user to routinely support the infant carrier by one forearm, with that forearm located at the near-side, squared-off corner. This location of the forearm at the near side of the bail quite clearly hangs the infant carrier in a laterally out-of-equilibrium position, such that the infant carrier has a tendency to roll sideways, away from the user, to return to equilibrium. The user's only clear compensation against sideways roll is to hug the carrier against the user's torso or juxtaposed leg as a stop. Thus, at least in some infant carriers, the user is placed under dual stress, both supporting the direct weight of the carrier and compensating against the tendency to roll.

Some users compensate for the manufacturer's design by hand carrying the carrier by the handle with the user's arm extended and the carrier against the leg. The user grips the top-side of the handle, nearer to the leg. Some carriers have Z-shaped or rotating handles in the top-center of the handle. These designs require the hand to be further from the leg, putting more pressure on the leg and causing more bounce and sway for the infant.

It would be desirable to provide a carrier handle that improves weight distribution and general comfort. The invention provides an elongated, padded, supplemental support that attaches to the handle, spreads the weight of the carrier over a wider part of the forearm and allows the user to control equilibrium and any tendency to roll. This invention also engages the carrier with additional portions of the arm in order to improve the ergonomics and comfort of engaging an infant carrier over one arm.

It would be desirable for an infant carrier to offer optimization for the user to support the carrier as personally preferred.

It would also be desirable for the user to have the option to locate a supplemental handle on the typical bail or other manufacturer-supplied carrying device.

To achieve the foregoing and other objects and in accordance with the purpose of the present invention, as embodied and broadly described herein, the apparatus of this invention may comprise the following.

BRIEF SUMMARY OF THE INVENTION

Against the described background, it is therefore a general object of the invention to provide a supplemental arm support for transporting an infant carrier, wherein the support improves weight distribution and general comfort of engaging the infant carrier over only one arm.

Infant carriers that convert from convertible car seat to carriers can be heavy. The combined weight of the carrier and the carried infant can be as much as forty-two pounds. Commonly, the user carries such a carrier at the user's side with arm extended. In this position, the carrier rests against the user's leg, which bounces the carrier and infant and causes fatigue in the user's hand. Alternatively, transporting the carrier with its handle in the crook of the user's arm puts all the weight of the carrier on a roughly 2 inch wide area of the arm. The supplemental support for an infant carrier solves the problem of difficult-to-carry infant carriers. The supplemental support is a padded device that clamps to any infant carrier handle and distributes the weight over a longer portion of the forearm, close to the bicep.

The supplemental support is both functional and fashionable. As compared to the typical two-inch width of an infant carrier handle, the support relieves the pressure imposed by the infant carrier, including the weight of the infant, by providing improved weight distribution over the forearm. The supplemental support is easily repositioned for different users or different preferences and can be reused on different infant carriers.

According to the invention, a supplemental support has been created for use in combination with a conventional infant carrier that is formed of a body and a superstructure handle. The supplemental support engages the handle of the conventional infant carrier to carry the infant carrier from the crook of the user's arm. The support is constructed of a two-directional pad system, formed of first and second pad surfaces arranged at a near right angle to one another. The pad system includes a first forearm-engaging pad surface that is longitudinally elongated between forward and rearward ends. The first pad surface is configured in a longitudinally elongated arc that is downwardly open when the first pad surface is disposed in a horizontal orientation, such that in use the first pad surface is engagable atop a user's forearm when disposed along the dimension of longitudinal elongation. A second, rearward facing, upper-arm-engaging pad surface is arranged transversely to the longitudinal dimension of the first pad surface. The second pad surface is positioned near the rearward end of the first pad surface and establishes a two-directional pad system with the first pad surface. When in use, this pad system is engagable in the crook of a user's arm. A handle receptor is positioned above the first pad surface. The handle receptor has a receiving element in transverse orientation to the longitudinal dimension of the first pad surface. When the handle receptor is in use by receiving a handle of an infant carrier in the receiving element, the handle is received in transverse orientation to the longitudinal dimension of the first pad surface, at a position above the first pad surface.

According to another aspect of the invention, a supplemental support has been created for use in combination with a conventional infant carrier that is formed of a body and a superstructure handle. The supplemental support engages the handle of the conventional infant carrier to carry the infant carrier from the crook of the user's arm. The support is constructed of a two-directional panel system, formed of first and second panels arranged at a near right angle to one another. The pad system includes a first forearm-engaging panel that is longitudinally elongated between forward and rearward ends. The first panel is configured in a longitudinally elongated arc that is downwardly open when the first panel is disposed in a horizontal orientation, such that in use the first panel is engagable atop a user's forearm when disposed along the dimension of longitudinal elongation. A second, rearward facing, upper-arm-engaging panel is arranged transversely to the longitudinal dimension of the first panel. The second panel is positioned near the rearward end of the first panel and establishes a two-directional panel system with the first panel. When in use, this panel system is engagable in the crook of a user's arm. A handle receptor is positioned above the first panel. The handle receptor has a receiving element in transverse orientation to the longitudinal dimension of the first panel. When the handle receptor is in use by receiving a handle of an infant carrier in the receiving element, the handle is received in transverse orientation to the longitudinal dimension of the first panel, at a position above the first panel.

The accompanying drawings, which are incorporated in and form a part of the specification, illustrate several embodiments of the present invention and together with the description, serve to explain the principles of the invention. In the drawings:

DETAILED DESCRIPTION OF THE INVENTION

Figure 1:
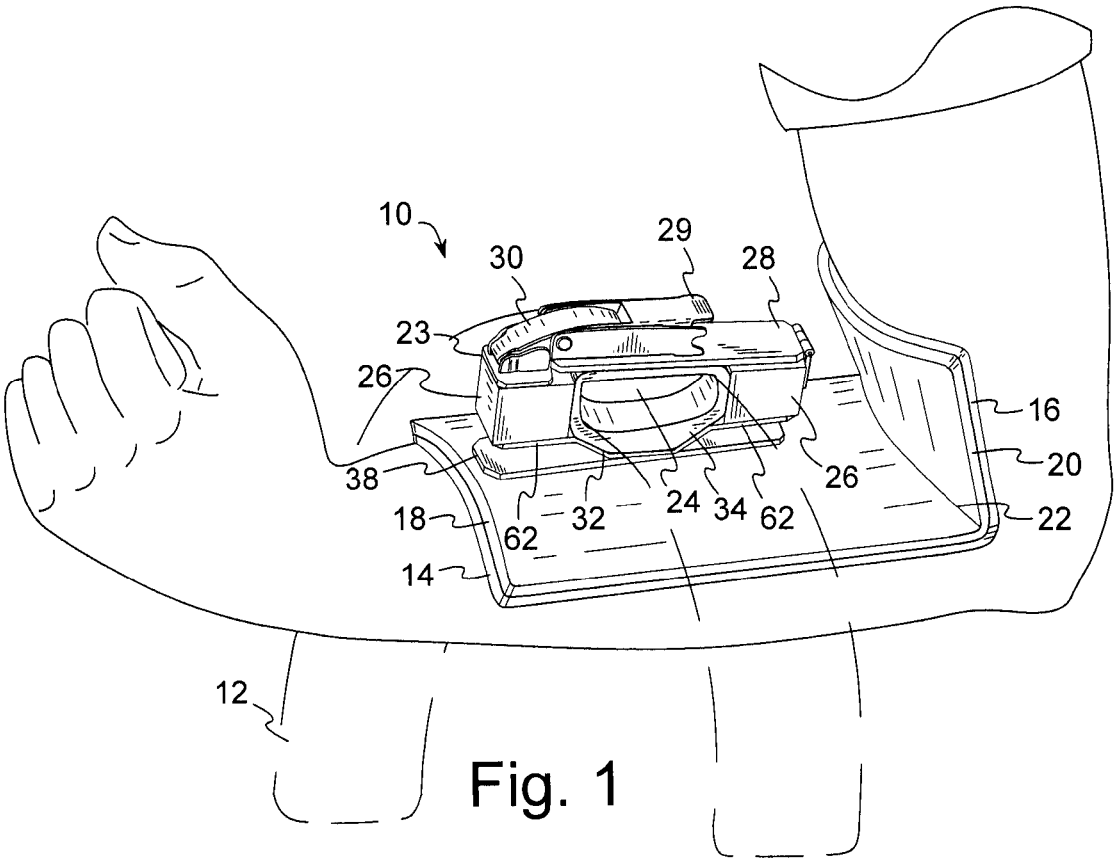
FIG. 1 is a side isometric view of one embodiment of the supplemental support, shown as engaged on a user's arm, and schematically showing an infant carrier handle engaged in the supplemental support.

The invention is a supplemental support 10 best used in combination with the typical commercial handle 12 of a typical, commercial infant carrier. In this instance, a "typical commercial handle" is characterized by narrowness of the handle where it reposes on a user's arm. Various observed commercial handles are about an inch wide, with some tending to be a bit wider, such as about one and one-half or two inches wide. These handles 12 have an available carrying position where they are arranged as superstructure above a body of the infant carrier. Despite the intention that such handles are useful for carrying the infant carrier, they have been found to be uncomfortable to carry across the user's forearm when a sizeable infant is resting in the infant carrier. In this instance, a typical "commercial infant carrier" refers to several commercially available brands that have been found on sale and are believed to be representative of present day construction in the art. Reference to typical commercial handles and typical commercial infant carriers provides an example of where the invention is best used but is not intended to be a limitation. The invention can be scaled to improve the carrying characteristics of substantially any infant carrier providing a cross-forearm handle, regardless of whether such infant carrier is characterized as "typical" or "commercial." The invention rests on a user's arm to enable the user to carry the infant carrier in comfort and in a mechanically favorable position. For convenience of description, the supplemental support may sometimes be referred to as an "arm rest," herein.

The supplemental support or arm rest is intended to resolve three interrelated problems that presently result from the normal use of a typical commercial infant carrier with a typical commercial handle 12 that is oriented to cross the user's forearm during normal use.

The first problem is the concentration of weight over a relatively small footprint on the user's arm. This is solved by providing the arm rest with a first pad that provides a relatively larger footprint against the user's arm. The first pad is elongated in the longitudinal dimension of the user's forearm. Beneficially, the first pad is arched over the axis of elongation, with the arch being similar in diameter to a human forearm so that the pad provides closer engagement to the user's forearm than is found in the typical bow of an infant carrier handle. It may be noted that the arch of many infant carriers has a diameter equal to the width of the infant carrier, which may be a foot or more wide. The favorable ergonomics of the narrower arch help prevent the carrier from slipping either longitudinally or transversely on the user's arm.

The second problem is the mechanical disadvantage or unfavorable leverage that results when the typical infant carrier handle is applied over the user's forearm too far from the user's elbow, or from the crook of the user's arm. This is solved in the arm rest by providing a system of multi-directional pads composed of at least two pads or portions of a single pad arranged to face in different directions, where the two directions are at a near right angle to one another. The term "near right angle" includes that the system of pads might be at a right angle. A first pad or a portion thereof, described above, is shaped and oriented for providing the elongated, generally downward facing pad surface for resting on the user's forearm with a substantial, elongated footprint. A second pad or portion thereof is shaped and oriented for providing a generally rearward facing pad surface for resting against the user's bicep or upper arm with a substantial footprint. Together, these two pads or pad portions of the arm rest invite the proper positioning of the infant carrier with respect to the user's bent arm, providing confidence for the user to place the arm rest in the crook of the user's arm. In particular, the second pad is generally transverse and upstanding from the first and by this position invites the user to place the arm rest further back on the arm than otherwise might occur. It may be noted that in at least one embodiment, the described first and second pads might be formed of a single pad body that is bent or shaped to provide substantial contact surfaces facing both downward against the user's forearm and rearward against the user's upper arm.

The third problem is to control the position of the infant carrier's handle on the user's arm as well as on the arm rest to optimize leverage at the crook of the user's arm. If the typical, narrow commercial handle is placed too far back on the user's bent arm, it might slip into the crook of the arm and cause discomfort by applying too much pressure against the joint at the forward face of the elbow and the user's bicep. This forward face of the elbow joint can be sensitive due to the flexed condition of the arm and presence of tight tendons near the forward surface of the joint. The second pad eliminates the user's need for caution in placing the infant carrier too far back by offering the inherent security of the generally upward extending second pad, which spreads rearward pressure from the infant carrier over a relatively large footprint on the bicep, spaced above the joint. The second pad serves as a stop that prevents the first pad from slipping back into the elbow joint.

To provide still more favorable leverage, the arm rest provides a specific receptor for the infant carrier handle. The receptor is positioned near the second pad, to further control the position of the infant carrier's handle for best mechanical advantage.

The new arm rest 10 is suited to support the infant carrier from a user's forearm upon the surface of a primary support including at least a first pad 14, with a secondary support at the rear of the primary support and including at least a second pad 16 disposed transversely to the primary pad 14 and extending upwardly therefrom, when the first pad is near horizontal, such that the surface of pad 16 interacts with the user's upper arm. The primary support is configured with longitudinal elongation between a forward end, such as to the left end in the views of FIGS. 1 and 2, and rearward end, such as to the right end in the views of FIGS. 1 and 2.

The primary support is configured in an arc suited to engage atop a user's forearm, when the forearm is disposed near horizontal, along the longitudinal dimension of the primary support. The user's forearm typically will be oriented with a substantial horizontal component so that the infant carrier can hang from the forearm. The primary support typically rests on the top side of the user's forearm, thus substantially sharing the horizontal orientation of the forearm. For convenience of description, the longitudinal elongation of the primary support can be described as a horizontal elongation, and the arc of the primary support can be described as downwardly open when the primary support rests on top of the user's arm, disposed in horizontal orientation. With such similar longitudinal orientation of the primary pad and the length of the user's forearm, downward forces applied to the primary pad are distributed over a substantial length of the user's forearm.

The secondary support is configured to abut the user's bicep when the upper portion of the user's arm is approximately at a right or forward acute angle with respect to the forearm. When the primary support is substantially horizontal, the secondary support can be described as oriented with a substantial vertical component so that the secondary support is suitably positioned to serve as a rearward facing pad that engages against the user's upper arm. It is desirable for the arm rest to fit into the crook of the user's arm so that the infant carrier is supported without applying undue leverage on the user's forearm. The secondary support acts as a stop by contacting the upper arm, preventing the primary support of the arm rest from shifting too far backwards into the elbow joint or against the upper arm, which otherwise might cause discomfort.

Figure 9:
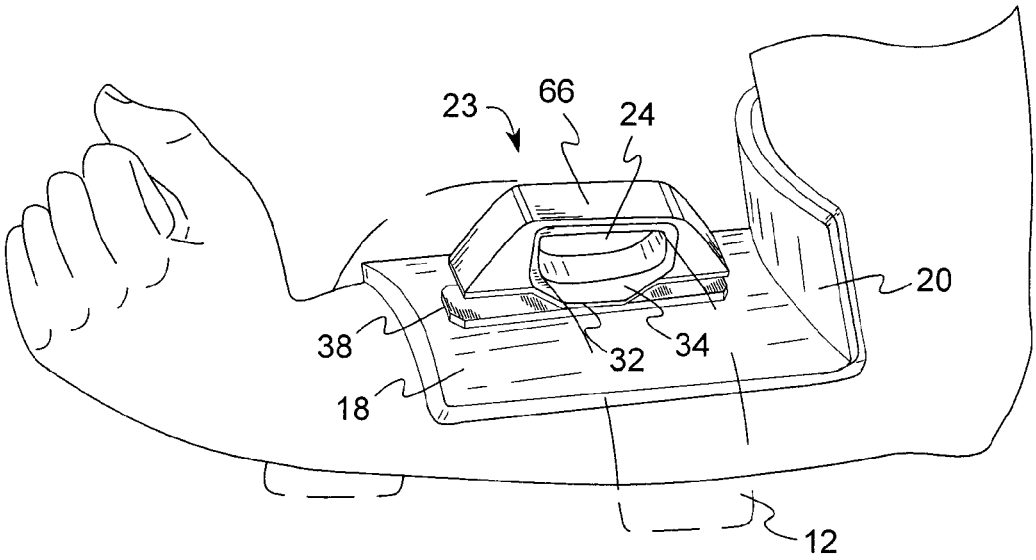
FIG. 9 is a view similar to FIG. 1, showing modified receptor in a fourth embodiment of the arm rest.

The angle between upper and lower arm support portions, with an infant carrier supported at the crook of the arm, is likely to be acute, as shown in FIGS. 1 and 9. The user's arm may be bent at slightly more than a right angle, such that the upper arm is angled slightly to the rear with the elbow at the rear of the upper arm. The secondary support can be disposed at an acute angle to the primary support in order to provide an ergonomic fit to the bend of the user's arm, as again shown in FIGS. 1 and 9. An acute angle in the range from seventy-five to ninety degrees is suitable, with eighty-five degrees being typical. If desired, the primary and secondary supports may be connected on a pivot so that the angle between them can vary according to need, over a range of angles in order to match the angle between upper arm and forearm at any of such angles. For convenience of description, the position of the secondary support can be described with respect to the position of the primary when disposed horizontally, with the secondary support configured with generally vertical dimension between a top end and bottom end, and where the bottom end is near the rearward end of the primary pad. The secondary support can be further described as configured in a rearward open arc, arched about a vertical axis, for receiving and engaging against a user's bicep, when the bicep is aligned along the generally vertical dimension of the secondary support. With such similar vertical alignment between the arc of the secondary pad and the length of the user's bicep, front-to-rear forces applied to the secondary pad are distributed over a significant contact area with the user's bicep.

Both primary support and secondary support may further or alternatively include a reinforcing backing plate or panel, such as a first backing plate or panel 18 carrying first pad 14 and a second backing plate or panel 20 carrying second pad 16. Where the two supports are disposed at a fixed angle, the primary and secondary supports may share a common intersection 22. The resulting angle between the two backing plates or panels may be near a right angle or at a slightly acute angle, as described above. The resulting arm rest is approximately L-shaped, where the included angle between the arms of the "L" can range from a right angle to a slightly acute angle.

The specific identity of a pad or a panel may converge or be interchangeable. In some instances, arm rest 10 may be formed as a two-panel system where the primary support is panel 18, and the secondary support is panel 20. Depending upon the chosen material of construction, the panels 18, 20 may have satisfactory characteristics that pads 14, 16 are not required. In some instances, pads 14, 16 may have sufficient characteristics that panels 18, 20 are not required. However, the presence of both a backing panel 18, 20 with a surface pad 14, 16 will be used hereinafter for purposes of description and not limitation.

The primary and secondary supports may be formed of a single, molded, reinforcing plate, with the primary or forearm plate 18 carrying pad 14 and the secondary or bicep plate 20 carrying pad 16. The primary support is represented by the longer arm of the L-shape and typically is oriented approximately horizontally when in typical use as suggested by the user's arm in FIGS. 1 and 9. The secondary support is represented by the shorter arm of the L-shape and is oriented approximately vertically or angled forward at an acute angle toward the primary support when in typical use as suggested in FIGS. 1 and 9.

Figure 10:
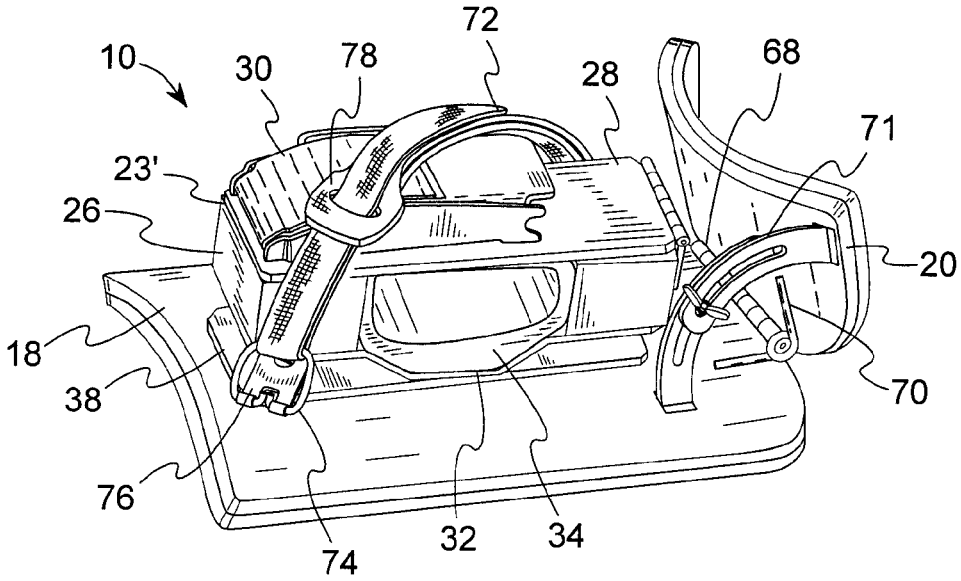
FIG. 10 is a view similar to FIG. 1, showing a modification with added safety strap and a hinged junction between primary and secondary plates.

Optionally, the reinforcing plates are joined by a pivoting mechanism that permits the angle between the panels to be varied through a preselected range of angles so that the angle between the two panels is variable. FIG. 10 shows a suitable mechanism to be a hinge 68 that joins separate panels 18 and 20. For convenient operation of the arm rest, the panels 18 and 20 are maintained within an acceptable range of angled relationship at least for initial arm engagement, such as between eighty-five and ninety degrees. A suitable limiting mechanism, such as a stop, a spring, or a connecting rod of variable length, establishes a preselected angle. Hinge 68 may include built-in stops for both a maximum and minimum angle, such that the hinge can move only through the acceptable range, and a means for biasing the hinge toward open position, such as a spring in the hinge, can bias the hinge to a selected angle at the maximum angle of the range. In place of a spring, the hinge may have an associated means for securing the pivot junction at a preselected angle within the preselected range of angles. FIG. 10 shows an example of suitable securing means to be a system 71 of two bypassing arced plates that are locked at a selected angle by a wing nut. Various other types of stops, screws, telescoping arms, or variable length arms also can secure the angle.

In another arrangement, the maximum angle may be set as a limit, but the panels are allowed to fold until they strike another part of the arm rest. For example, spring 70 cooperates with hinge 68 to establish a neutral, maximum open position. An acceptable maximum relative angle is open to ninety degrees. The spring 70 can be compressed by asserting pressure on the panels to decrease this angle. When a user first engages the arm rest, the panels will be at the maximum opening. If the user closes his arm, the spring allows the panels fold together against the spring force to accommodate the decreased angle. Panel 20 can be foldable toward panel 18 until a limiting mechanism prevents further folding. The limiting mechanism can be either the spring force or interference with any other part of the arm rest.

Figure 7:
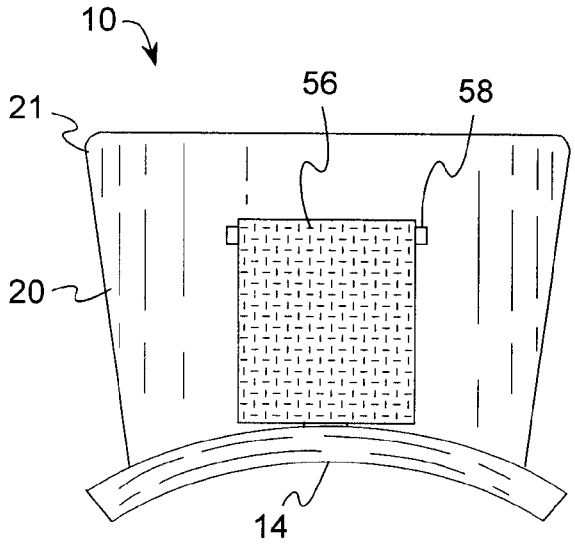
FIG. 7 is a front view of the third embodiment of the arm rest.

As best shown in FIG. 7, the secondary pad and backing plate may widen with increasing distance from the primary pad. The wider top 21 of the secondary pad acts against a higher portion of the user's upper arm, which can be expected to be broader with increasing height.

With reference to FIGS. 1-9, in one embodiment the arm rest 10 is configured as a supplemental attachment for an infant carrier of nonspecific design, such as for substantially any commercially produced infant carrier. For this application, the arm rest 10 is configured to have a handle receptor 23 for receiving carrier handle 12, with minimal requirements for the exact configuration of the handle 12. The handle receptor 23 is a partially open structure that might be a dished area or channel that lies across the primary support, allowing the infant carrier handle to be inserted into the handle receptor 23 to rest across the arm rest, above pad 14, and to be held in place by gravity.

The handle receptor 23 may include a receiving element such as latchable recess or transverse passage 24 for receiving the handle 12 and for securing the handle by clamping force, for improved security in maintaining the carrier and arm rest in engagement. Such a recess 24 can be bounded by spaced apart end blocks or end walls 26, and a hinged cover panel establishes a closeable top wall 28. A selectively operable latch or clamp, such as an operating lever 29 that selectively closes to varying degrees, can secure the top wall 28 in closed position over an inserted handle 12. The latch can be variable in its closing force so that it can secure the cover panel over the open portion of the receptor to vary the size of the receiving element to fit different handles 12. One embodiment of the latch is a flexible spring latch 30. When latch 30 is closed to an increasing degree, it decreases the available size of the receiving element.

Figure 2:
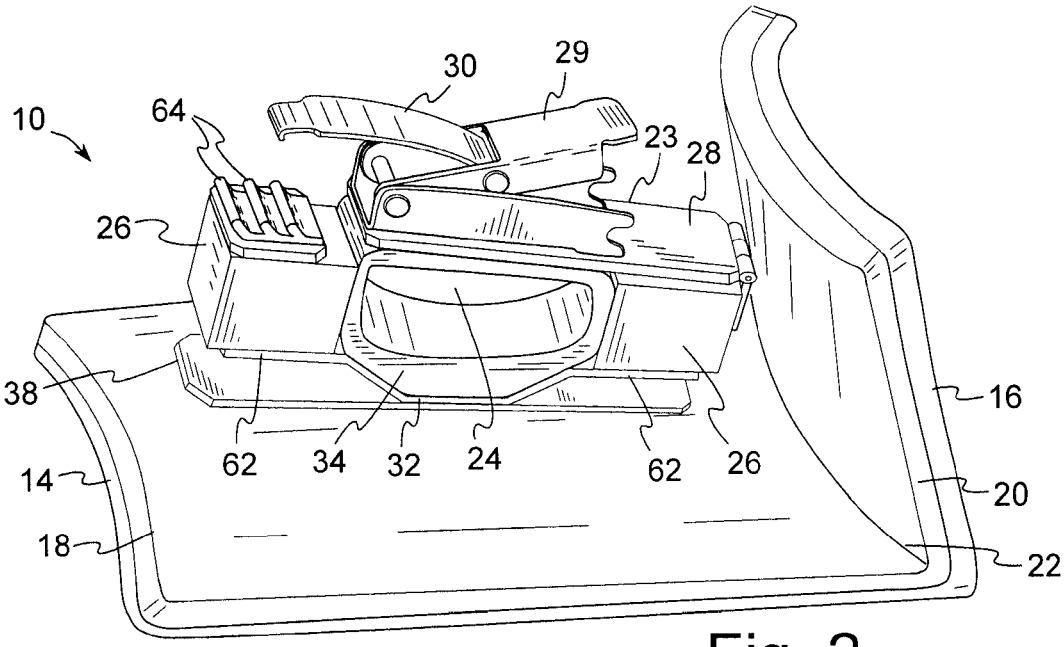
FIG. 2 is a side isometric view of the supplemental support of FIG. 1, shown with the latch in open position to reveal a multi-position latch receiver.

While a handle might rest directly on one of the primary supports, the receptor 23 may include a separate bottom wall 32. In FIGS. 1 and 2, the bottom wall has a central channel and opposite level flanged ends. A variably configured foam filler 34 might occupy a part of the recess 24 to adapt the shape of the recess to the cross-sectional shape of the received carrier handle 12.

Figure 3:
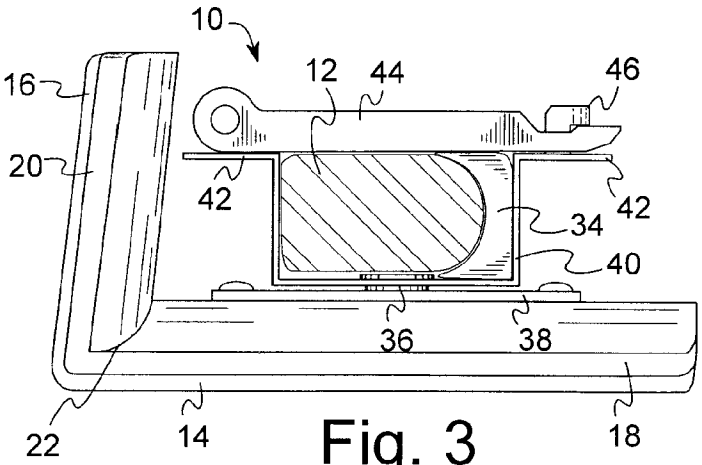
FIG. 3 is a side elevational view of a second embodiment of the supplemental support, shown engaging the handle of an infant carrier, with the handle in cross-section.

Handle receptor 23 may be mounted to the primary support on an optional swivel joint 36, best shown in FIG. 3, but applicable to any of the embodiments. The swivel joint 36 allows the handle receptor to rotate with respect to the pads or backing plates, allowing the infant carrier and two pads of arm rest 10 to assume variable angular positions with respect to one another. In the typical arrangement as suggested by FIG. 1, the swivel joint 36 permits rotation on an approximately vertical axis. A receptor 23, combined with a swivel joint 36, may employ a base plate 38 that is mounted to a backing plate or pad to attach the handle receptor 23. The base plate 38 can be mounted to bottom wall 32 of handle receptor 23 by a swivel element such as a pin or tube that establishes the swivel joint. Optionally, a locking mechanism can be added to the swivel point to lock the swivel in a fixed position, if desired.

Figure 4:
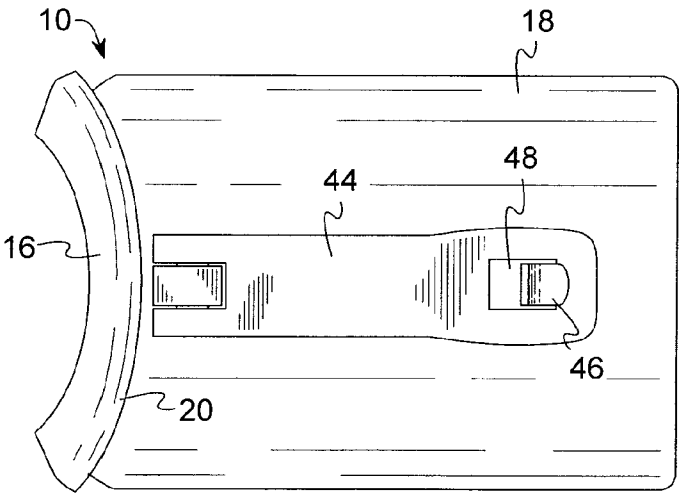
FIG. 4 is a top plan view of the second embodiment of the supplemental support.

With reference to FIGS. 3-8, variable details of the arm rest 10 include the selection of a suitable handle receptor 23 and latch. In FIGS. 3 and 4, the handle receptor is formed of a channel-shaped frame 40 of suitable size and configuration for containing carrier handle 12 and filler 34. The channel-shaped frame 40 includes end walls 26 and a bottom wall 32, shown in FIG. 1. The frame further includes opposite top flange walls 42 that carry a latch plate 44 hinged to one of the top flange walls. A flexible hook 46 on the opposite flange wall engages the latch plate 44 through an aperture 48.

Figure 5:
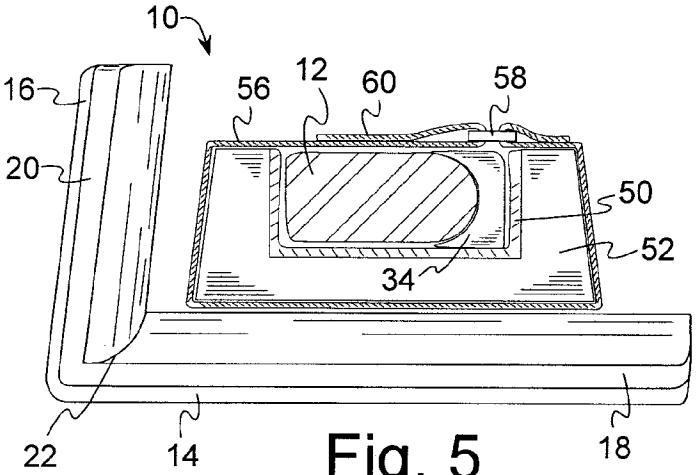
FIG. 5 is a side elevational view of a third embodiment of the supplemental support, shown engaging the handle of an infant carrier, with the handle in cross-section.
Figure 6:
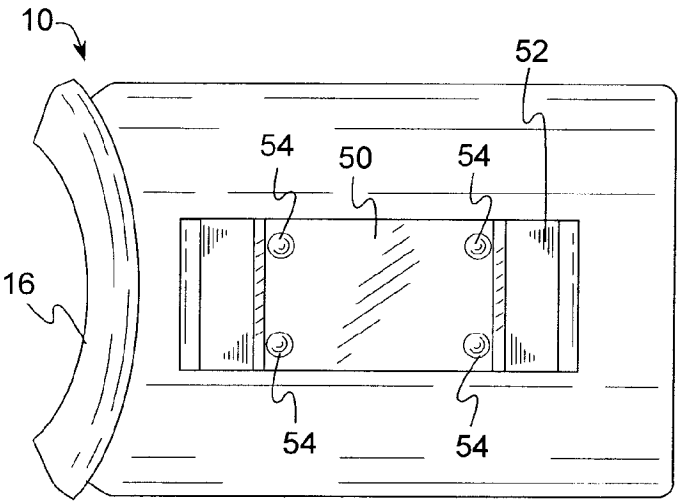
FIG. 6 is a top plan view of the third embodiment of the arm rest.
Figure 8:
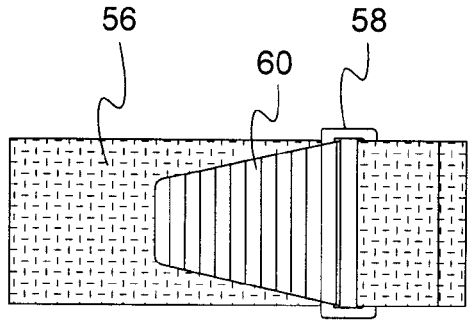
FIG. 8 is a top plan view of the latch portion of the third embodiment of the arm rest.

In FIGS. 5 and 6, a channel-shaped receptor 50 is nested in a trapezoidal block 52. Receptor 50 may be secured to block 52 by a plurality of screws or rivets 54. A belt 56 is carried on the block in a position to close over the open top of the receptor channel. The belt may at least partially wrap the block. The belt is selectively closed over the open top of the receptor 50 to secure handle 12 inside the channel. The belt may be closed by a fastener such as buckle 58. As best shown in FIG. 8, the belt may be formed of hook-and-loop material with a fold-over end 60 that can be wrapped through buckle 58 and folded back over the hook-and-loop material to fasten the belt to itself.

A prototype infant carrier arm rest 10, similar to the embodiment of FIGS. 1 and 2, was conveniently constructed from the side wall of a prefabricated Y-joint of white six inch PVC pipe. Suitable dimensions for the prototype were found to be: length of pad 14=6⅛ inches; height of pad 16=3¾ inches; width of pad 14=4 inches; width of pad 16 at top=4 inches. The prefabricated Y-joint provided a forward-leaning eighty-five degree turn at junction 22, resulting in the secondary support angling acutely forward to fit into the crook of the user's arm. The receptor 23, 50 can fit partially under the forward leaning secondary support, bringing the load point for the infant carrier close to the user's bicep. A rotating light fixture clamp was used to form bottom wall 32, base plate 38, and the swivel mechanism. Testing indicated that a rotating arm rest would be more comfortable since the arm moves slightly as the parent walks, and rotating the arm rest would keep it positioned over the forearm. The base plate 38 of the rotating receptor was bolted, with nuts and lock washers, to the pipe wall along the longitudinal axis of the primary support. In this position, the bolts were typically hidden under the upper body of receptor 23, as long as it remained approximately aligned with the longitudinal axis of the primary support.

In the prototype, the bottom wall 32 of rotating receptor 23 had a central padded indentation where the carrier handle 12 rests. At each end of the central indentation, the bottom wall 32 extends as slightly elevated, opposite flange walls 62, as best shown in FIG. 2. Bolts extending into spacer blocks 26 at the opposite ends of the latch extend through these flanges of the bottom wall. A suitable size for a wooden spacer block 26 is seven-eights inch high, one inch by one inch square. The spacer block is located between the bottom wall flanges 62 and the appropriate portions of the latch at each end of the receptor 23. Thus, the latch is mounted or supported on the two bottom wall flanges. The prototype receptor 23 was one inch wide and showed a small amount of wobble with respect to the carrier handle. As a result, the receptor is recommended to be one and one-half inches wide at all sides of the carrier handle, as suggested by the wider receptor 23' shown in FIG. 10.

As best shown in FIG. 2, the latch provides a means for variably closing in order to accommodate different sizes of carrier handles. A portion of the latch provides multiple closing positions. For example, one or more upstanding teeth 64 or similar latch receiving devices are permanently fixed to one of the wooden spacers 26. The longer operating lever 29 and spring latch 30 are carried on top wall 28, which is hinged to the second wooden spacer 26. The spring latch 30 is selectively engaged and closed over any of teeth 64 to close the latch.

The prototype rotating latch, formed of wooden spacers 26 and the clamp mechanism, form a passage 24 that is sized approximately as one-half inch high and two inches wide. A typical commercial carrier handle 12 fits in this passage. Foam padding 34 surrounds the passage to pad the carrier handle 12. However, many carrier handles 12 change width along the length of the handle from about two inches along the side and at a curve on top, to less than one and one-half inches along the top where the hand normally grips the carrier handle. In order to adapt the fit of the arm rest 10 to the possible variations in the contour of the carrier handle 12, various additional pads or fillers 34 may be supplied with the arm rest 10 to accommodate the different handle sizes. Extra padding should be attachable with low tack adhesive so that the arm rest 10 can be fitted to receive different carrier handles 12 or different portions of a single carrier handle 12. Prototype testing showed that one user changed the position of the arm rest 10 on his carrier handle several times until the user cradled the carrier upright with the least force of the carrier against the user's hip.

With reference to FIG. 9, in another application, the arm rest might be affixed to an infant carrier as an item of original equipment manufacture. In this instance, the receptor 23 might be affixed to a selected part of the infant carrier in a permanent way, not requiring after-market attachment by a readily operated latch. The primary backing plate 18 and secondary backing plate 20 may be configured as described in prior embodiments. The receptor 23 may be formed of a shell 66 that is shaped to define a passage 24 for receiving a specifically contoured carrier handle 12, and a cushion 34 in passage 24 may be present to ensure a firm grip on the handle 12. The passage 24 within shell 66 of FIG. 9 may be configured as a channel with an open bottom edge. A bottom wall 32 may be attached to shell 66 as a closure panel that is sized to close the passage 24 around the handle 12. Closure panel 32 may be attached across the open channel edge by conventional fastening means, such as screws anchored into shell 66, which serve as latching devices. The screws may be accessible when the receptor is transversely pivoted to a sufficient angle to expose the screw heads. The bottom wall 32 and base plate 38 may be interconnected by a swivel joint, previously described. The base plate 38 provides a convenient means for mounting the receptor 23 to the primary backing plate 18.

The experience gained by building and testing the prototype produced the following recommendations for producing a commercial version of the arm rest 10. The production arm rest backing plates 18, 20 should be one-piece of molded, high impact plastic, approximately one-quarter inch thick. A six inch diameter arc is an appropriate curve for the reinforcing plates 18, 20, which allows adequate space for padding 14, 16 that rests on the user's forearm and bicep. An arc of less than six inch diameter should be used with caution so that the arm rest 10 does not interfere with the carrier's sun shade or canopy, if any. Specifically, the combined thickness of primary plate 18 and padding 14 should be limited so that the user's arm remains sufficiently close to the carrier handle 12 to avoid interfering with any movable sun shade or canopy that is present. A suitable thickness for pads 14, 16 is about one-quarter inch. Pads 14, 16 may be formed of closed-cell foam, with an optional covering of cloth or other absorbent material for wicking away perspiration and making the arm rest more attractive.

Receptor 23 should be positioned close to the secondary plate 20 or pad 16 so that the carrier is supported close to the user's elbow joint and bicep. It is desirable that the carrier 12 be supported from as close to the bicep as possible, rather than on a distant part of the forearm. Weight applied too far forward on the forearm unnecessarily tires the bicep.

The receptor 23 should be attached to the supports 14, 16 or backing plates 18, 20 by a durable swivel element 36 so that the user's forearm can move while walking without causing the user's arm to shift in and out of support 14 and plate 18. The swivel mechanism 36 should be designed for durability. The operating position of the arm rest 10 under the carrier handle 12 establishes an extra degree of safety, in that the carrier handle could continue to be supported on the arm rest 10 by gravity even if the swivel joint failed. During prototype testing, the swivel joint that was formed of a light fixture swivel did not experience any failures.

The latch 30 firmly secures the arm rest 10 to the carrier handle 12. Carrier handles are generally about one inch thick, but the handle varies in width along the handle and among manufacturers. The carrier handle receiving area 24 should come padded with at least one-eighth inch of high density foam along all surfaces. Extra pieces of padding in various thicknesses should be included with the arm rest 10 to fill-in the receiving area 24 as required to ensure a tight fit.

Latch 30 provides multiple latch mating teeth 64 in spaced array, providing selectable snugness for the closed latch. Such a latching system is similar to the latches with a series of mating teeth as commonly used on a ski boot. The spaced series of attaching points 64 for buckle mechanism 30 allows arm rest 10 to attach to handles 12 of different selected widths.

A clamp as shown in any of the embodiments is suitable to close the receiving area 24. The clamp 30 with spring clip as shown in FIGS. 1 and 2 was found to be convenient and secure. The clamping mechanism shown in FIGS. 3-4 may have the advantage of familiarity, if the user has seen it in other applications such as the seat belt clamp used to install car seats.

The strap with a buckle of FIGS. 5-8 is offered as a proposal for further testing and evaluation before commercial use. Such a strap would need to be tight and secure. The illustrated embodiment does not include a swivel joint 36, but the inherent flexibility of a strap could provide sufficient flex to allow some arm movement. A particular advantage of using a strap 56 as the clamp is that it can be located closer to intersection 22 than allowed by the mechanical action of the other embodiments.

A safety strap 72 can be used with any of the disclosed embodiments as an added protective measure. As shown in FIG. 10, the safety strap 72 wraps over the latch 30, both holding shut the latch and serving as a backup latch in the event the clamping mechanism should open. Additionally, the safety strap maintains an association between receptor 23 and base plate 38 in the event that the swivel mechanism 36, FIG. 3, should fail. In the unlikely event of a failure, the safety strap also maintains the association between components of the arm rest and the carrier handle 12, FIGS. 1 and 3, so that no broken or loose component can fall into the carrier.

In order to achieve these multiple functions, the opposite ends of the safety strap are engaged with panel 18. One or both ends of the strap can terminate in a means for mounting the strap to panel 18. Conveniently, the mounting means can be a mounting ring 74 that is attached to panel 18. A mounting ring 74 can be carried on a mounting plate 76, which can be attached to panel 18. In turn, the mounting plate can be fastened to either base plate 38 or directly to panel 18. As an alternative, the safety strap can be attached at one end to panel 20, or another equally suitable mounting pattern can be devised, including securing a portion of the strap under base plate 38 so that mounting rings and mounting plates would not be required.

Figure 11:
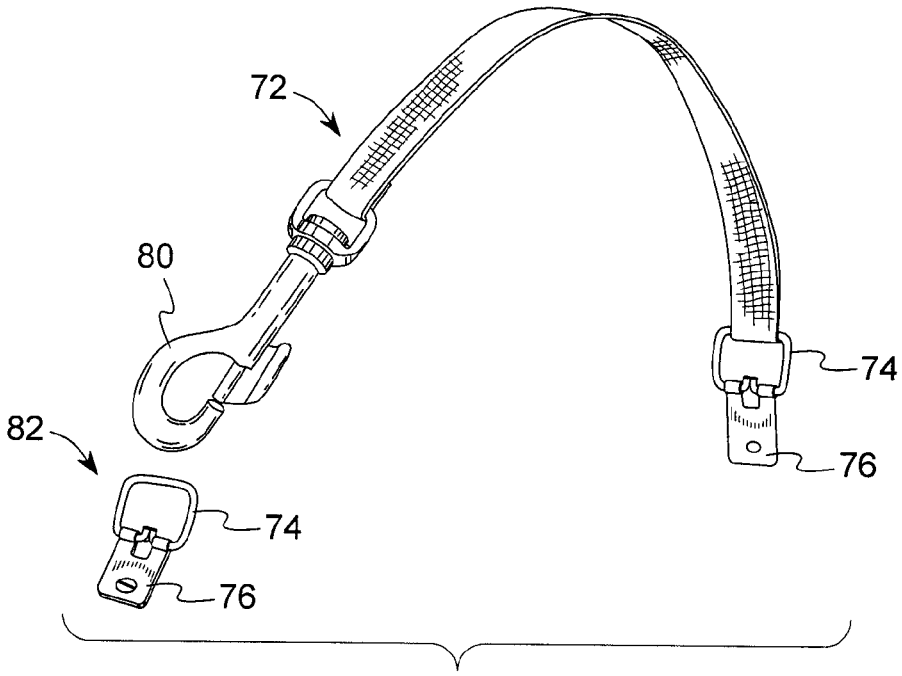
FIG. 11 is an isometric view, showing a safety strap useable with all embodiments of the support.

As illustrated in FIG. 10, safety strap 72 can be formed of two strap portions that fasten together, such as by a buckle 78, adhering texture, catch, or latch, from secured points on opposite or diagonal locations with respect to the clamp. As illustrated in FIG. 11, the safety strap 72 can be formed of a single strap mounted by one end to one of the mounting plates 76. Such a single strap has a fastening means on its free end, such as snap hook 80, that is engagable with the mounting ring 74 at an opposite mounting structure 82.

Appearance is an important factor to the user or parent in the purchase of accessories. The arm rest body could be molded in a neutral color, and in pink and blue or with several design options. The body could also be covered with a variety of fabrics designed as skins or slipcovers that could be purchased separately.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention.

What is claimed is:

1. A supplemental support for use in combination with an infant carrier having a body and a superstructure handle, for supporting the infant carrier from its handle upon the supplemental support at the crook of the user's arm, comprising:

a two-directional pad system formed of first and second pad surfaces arranged at a near right angle to one another, including both a first forearm-engaging pad surface that is longitudinally elongated between forward and rearward ends, configured in a longitudinally elongated arc that is downwardly open when said first pad surface is disposed in a horizontal orientation, such that in use the first pad surface is engagable atop a user's forearm when the forearm is disposed along said dimension of longitudinal elongation; and a second, rearward facing, upper-arm-engaging pad surface arranged transversely to said longitudinal dimension of said first pad surface, positioned near said rearward end thereof, and establishing therewith said two-directional pad system that, when in use, is engagable in the crook of a user's arm;

a first backing plate carrying said first pad surface;

a second backing plate carrying said second pad surface;

wherein said first and second backing plates are joined together at an angle establishing said two-directional pad system; and a handle receptor positioned above the first pad surface, having a receiving element in transverse orientation to the longitudinal dimension of the first pad surface such that when in use by receiving a handle of an infant carrier in the receiving element, such handle is received in transverse orientation to the longitudinal dimension of the first pad surface, at a position above the first pad surface.

2. The supplemental support of claim 1, wherein:

said junction between first and second backing plates is pivotal through a preselected range of angles; and further comprising means for biasing said pivot junction toward the maximum angle within said preselected range of angles.

3. The supplemental support of claim 1, wherein:

said junction between first and second backing plates is pivotal through a preselected range of angles; and further comprising means for securing said pivot junction at a preselected angle within said preselected range of angles.

4. The supplemental support of claim 1, wherein:

said second backing plate is angled acutely forward with respect to said first backing plate.

5. The supplemental support of claim 1, further comprising:

a swivel joint interconnecting said handle receptor and said two-directional pad system, whereby the handle receptor is rotatable with respect to the two-directional pad system, when in use by receiving a handle of an infant carrier in the receiving element, allowing the infant carrier and two-directional pad system to assume variable angular positions with respect to one another; and said swivel joint is oriented to swivel on an approximately vertical axis with respect to said first pad surface when the first pad surface is in a horizontal orientation.

6. The supplemental support of claim 5, wherein:

said swivel joint further comprises a base plate connected to said first backing plate;

said handle receptor further comprises a bottom wall; and the swivel joint further comprising a swivel element that interconnects said base plate and bottom wall.

7. The supplemental support of claim 1, wherein with respect to said first pad surface when disposed in a horizontal orientation, said second pad surface is configured in a rearwardly open, vertically oriented arc for, in use, engaging against a user's bicep when disposed in similar vertical orientation.

8. The supplemental support of claim 1, further comprising:

a swivel joint interconnecting said handle receptor and said two-directional pad system, whereby the handle receptor is rotatable with respect to the two-directional pad system, when in use by receiving a handle of an infant carrier in the receiving element, allowing the infant carrier and two-directional pad system to assume variable angular positions with respect to one another.

9. The supplemental support of claim 8, wherein:

said swivel joint is oriented to swivel on an approximately vertical axis with respect to said first pad surface when the first pad surface is in a horizontal orientation.

10. The supplemental support of claim 1, further comprising:

a safety strap passing over said handle receptor and anchored to said pad system.

11. The supplemental support of claim 1, wherein:

said receiving element is configured to provide at least a portion of a transverse passage to said longitudinal dimension of said first pad surface, having an open perimeter portion permitting, in use, insertion of an infant carrier handle into said receiving element;

further comprising a cover panel that is selectively openable and closable over said open perimeter portion, including a latch that is selectively operable between unlatched and latched positions, securing said cover panel in closed position over said open perimeter portion when in latched position.

12. The supplemental support of claim 11, wherein:

said latch is selectively latchable in a plurality of degrees ranging from lesser degree to greater degree, said receiving element and latch relatively decreasing the size of said transverse passage with operation of the latch to greater degree, whereby the receiving element is adjustable, in use, to fit a plurality of inserted infant carrier handle sizes.

13. The supplemental support of claim 11, wherein said receiving element is a channel providing said transverse passage, and said open perimeter portion is an open top edge of said channel.

14. The supplemental support of claim 11, wherein said latch is a spring latch.

15. The supplemental support of claim 11, wherein said latch is a strap and buckle.

16. The supplemental support of claim 11, wherein said latch is a screw.

17. The supplemental support of claim 11, wherein said receiving element is a channel providing said transverse passage, and said open perimeter portion is an open bottom edge of said channel.

18. The supplemental support of claim 11, wherein said receiving element further comprises:

a lining of said transverse passage, formed of a resilient material.

19. A supplemental support for use in combination with an infant carrier having a body and a superstructure handle, for supporting the infant carrier from its handle on the supplemental support at the crook of the user's arm, comprising:

a two-directional panel system formed of first and second panels arranged at a near right angle to one another, including both a first forearm-engaging panel that is longitudinally elongated between forward and rearward ends, configured in a longitudinally elongated arc that is downwardly open when said first panel is disposed in a horizontal orientation, such that in use the first panel is engagable atop a user's forearm when disposed along said dimension of longitudinal elongation; and a second, rearward facing, upper-arm-engaging panel arranged transversely to said longitudinal dimension of said first panel, positioned near said rearward end thereof, and establishing therewith said two-directional panel system that, when in use, is engagable in the crook of a user's arm; and a handle receptor positioned above the first panel, having a receiving element in transverse orientation to the longitudinal dimension of the first panel such that when in use by receiving a handle of an infant carrier in the receiving element, such handle is received in transverse orientation to the longitudinal dimension of the first panel, at a position above the first panel;

wherein:

said receiving element is configured to provide at least a portion of a passage that is transverse to said longitudinal dimension of said first panel, having an open perimeter portion permitting, in use, insertion of an infant carrier handle into said receiving element;

further comprising a cover panel that is selectively openable and closable over said open perimeter portion, including a latch that is selectively operable between unlatched and latched positions, securing said cover panel in closed position over said open perimeter portion when in latched position.

20. The supplemental support of claim 19, further comprising:

a swivel joint interconnecting said handle receptor and said two-directional panel system, whereby the handle receptor is rotatable with respect to the two-directional panel system, when in use by receiving a handle of an infant carrier in the receiving element, allowing the infant carrier and two-directional panel system to assume variable angular positions with respect to one another; and said swivel joint is oriented to swivel on an approximately vertical axis with respect to said first panel when the first panel is in a horizontal orientation.

21. The supplemental support of claim 19, wherein:

said latch is selectively latchable in a plurality of degrees ranging from lesser degree to greater degree, said receiving element and latch relatively decreasing the size of said transverse passage with operation of the latch to greater degree, whereby the receiving element is adjustable, in use, to fit plurality of inserted infant carrier handle sizes.

22. A supplemental support thr use in combination with an infant carrier having a body and a superstructure handle, for suspending the infant carrier from its handle upon the supplemental support at the crook of the user's arm, comprising:

a two-directional panel system formed of first and second panels arranged at a near right angle to one another, including both a first forearm-engaging panel that is of a first preselected front-to-rear length, is longitudinally elongated between front and rear ends thereof, and in use the first panel is engagable atop a user's forearm when the first panel and user's forearm are disposed in similar longitudinal orientation;

a second, rearward facing, upper-arm-engaging panel arranged transversely to said longitudinal dimension of said first panel, positioned near said rearward end thereof, and establishing therewith said two-dimensional panel system that, when in use, is engagable in the crook of a user's arm;

a handle receptor carried atop the first panel, defining a receiving passage positioned in transverse orientation to the longitudinal dimension of the first panel, such that when the handle receptor is in use by receiving a handle of an infant carrier in the receiving passage to suspend the infant carrier from the handle receptor, said handle is received in transverse orientation to the longitudinal dimension of the first panel, at a position above the first panel, wherein said receiving passage has an open perimeter portion permitting, in use, insertion of an infant carrier handle into said receiving passage, and wherein said handle receptor further comprises a cover panel that is selectively openable and closable over said open perimeter portion, including a latch that is selectively operable between unlatched and latched positions, securing said cover panel in closed position over said open perimeter portion when in latched position; and wherein said handle receptor is of a second preselected front-to-rear length that is shorter than the first preselected length of the first panel, whereby when in use with an infant carrier suspended from the handle receptor, the weight of the infant carrier is dispersed over the greater dimension of the first panel.

* * * * *